US009212790B2

(12) United States Patent
Chiang et al.

(10) Patent No.: US 9,212,790 B2
(45) Date of Patent: Dec. 15, 2015

(54) LIGHT EMITTING DIODE BULB

(71) Applicant: Lextar Electronics Corporation, Hsinchu (TW)

(72) Inventors: Ching-Chi Chiang, Hsinchu (TW); Kun-Hsiung Wang, Emei Township (TW); Chien-Hsin Tu, Taipei (TW)

(73) Assignee: LEXTAR ELECTRONICS CORPORATION, Hsinchu (TW)

( * ) Notice: Subject to any disclaimer, the term of this patent is extended or adjusted under 35 U.S.C. 154(b) by 0 days.

(21) Appl. No.: 14/336,420

(22) Filed: Jul. 21, 2014

(65) Prior Publication Data

US 2015/0117060 A1 Apr. 30, 2015

(30) Foreign Application Priority Data

Oct. 31, 2013 (TW) ..... 102139563 A

(51) Int. Cl.

| | |
|---|---|
| ***H01R 33/06*** | (2006.01) |
| ***F21K 99/00*** | (2010.01) |
| ***F21V 17/00*** | (2006.01) |
| *F21Y 101/02* | (2006.01) |
| *H01R 33/09* | (2006.01) |

(52) U.S. Cl.

CPC ..... *F21K 9/1355* (2013.01); *F21V 17/002* (2013.01); *F21Y 2101/02* (2013.01); *H01R 33/06* (2013.01); *H01R 33/09* (2013.01)

(58) Field of Classification Search

CPC ..... F21K 9/10; F21K 9/135; F21K 9/1355; F21K 9/17; F21K 9/175; F21K 9/30; F21K 99/00; F21V 17/00; F21V 17/04; F21V 17/002; F21V 19/003; F21V 19/005; F21V 19/0045; H05K 3/301; H01R 33/225; H01R 33/09

USPC ..... 362/650, 659

See application file for complete search history.

(56) References Cited

U.S. PATENT DOCUMENTS

| | | | | |
|---|---|---|---|---|
| 2013/0163261 | A1* | 6/2013 | Shimoji et al. | 362/382 |
| 2014/0146570 | A1* | 5/2014 | Lu et al. | 362/647 |
| 2014/0286020 | A1* | 9/2014 | Tsai | 362/363 |

FOREIGN PATENT DOCUMENTS

| | | | |
|---|---|---|---|
| TW | 201017030 | A | 1/2010 |
| TW | M425235 | U | 3/2012 |
| TW | I384170 | B | 1/2013 |

* cited by examiner

*Primary Examiner* — Y M. Lee

(74) *Attorney, Agent, or Firm* — Moser Taboada

(57) ABSTRACT

A light-emitting diode includes an electrical connecting base, a lamp holder, a power driving module, an adapter plate and a lamp plate. One end of the lamp holder is connected to the electrical connecting base and the other end of the lamp holder is configured to be a supporting surface. The electrical connecting base and the lamp holder form an accommodation space which accommodates the power driving module. The adapter plate has a first surface and a second surface opposite to each other. The first surface is contacted with the supporting surface and the second surface includes a first connector which has a plugging direction parallel to the second surface. The lamp plate has a second connector which is detachably plugged to the first connector, so as to be disposed on the adapter plate.

11 Claims, 6 Drawing Sheets

LIGHT EMITTING DIODE BULB

RELATED APPLICATIONS

This application claims priority to Taiwan Application Serial Number 102139563, filed Oct. 31, 2013, which is herein incorporated by reference.

BACKGROUND

1. Field of Invention

The present invention relates to a light emitting diode (LED) bulb, and more particularly to a LED bulb with a replaceable lamp plate.

2. Description of Related Art

In general, a conventional light emitting diode (LED) bulb is basically composed of a light source, a lamp holder, an electrical connecting base, and a power driving module. The lamp holder is usually made of thermal dissipation material or has a lot of heat dissipating fins around its side wall. The electrical connecting base is connected to one end of the lamp holder and the light source is disposed on another end of the lamp holder, and the power driving module is disposed inside the lamp holder.

In the conventional LED bulb, the power driving module and the light source are easily damaged when the lamp holder suffers extensive heat for a long term. While any one of the internal components of the conventional LED bulb is damaged, the whole set of the conventional LED bulb needs to be replaced. It is normally unable to individually replace a single damage component of the conventional LED bulb.

SUMMARY

One aspect of the present invention provides a light emitting diode (LED) lamp that is capable of replacing the internal component thereof, so as to solve the problem mentioned in related art.

According to one embodiment of the present invention, a LED bulb including an electrical connecting base, a lamp holder, a power driving module, an adapter plate and a lamp plate is provided. The lamp holder has a first end and a second end opposite to each other, in which the first end is connected to the electrical connecting base, the second end is configured as a supporting surface, and an accommodation space is formed by the electrical connecting base and the lamp holder. The power driving module is disposed inside the accommodation space. The adapter plate has a first surface and a second surface opposite to each other, in which the first surface is connected to the supporting surface and the second surface includes a first connector which has a plugging direction parallel to the second surface. The lamp plate is equipped with at least one LED and has a second connector detachably plugged to the first connector along the plugging direction so that the lamp plate is disposed on the adapter plate.

According to one embodiment of the present invention, the adapter plate includes a side wall, and the side wall is extended from a peripheral edge of the second surface and protrudes from the second surface to encircle the second surface.

According to one embodiment of the present invention, the first connector is adjacently connected to an inner face of the side wall.

According to one embodiment of the present invention, the lamp plate is composed of the first half-face and a second half-face, and the second connector is disposed on an edge of the second half-face, in which the first half-face is connected with the second half-face, and an area of the first half-face is greater than an area of the second half-face such that two end surfaces of the first half-face is exposed.

According to one embodiment of the present invention, a portion of the side wall has an opening, a position of the opening is opposite to a position of the first connector, and a width of the opening is equal to or greater than a distance between any two points on the second half surface.

According to one embodiment of the present invention, the two exposed end surfaces of the first half-face are respectively configured as two stopping portions, after the second half-face of the lamp plate passes through the opening of the side wall, and the second connector is inserted into the first connector, such that the two exposed end surfaces are abutted against two terminals of the opening.

According to one embodiment of the present invention, an edge of the first half-face has a protrusion configured to auxiliarly push the lamp plate into or pull out from the opening.

According to one embodiment of the present invention, the first connector has a slot which has a plurality of electrical contacts, and the second connector has a golden finger interface inserted into the slot for electrical connecting the plurality of the electrical contacts.

According to one embodiment of the present invention, the slot has a first side wall and a second side wall opposite to the first side wall, and an edge of the lamp plate has a first recess part and a second recess part located on two sides of the golden finger interface respectively. A recess width of the first recess part is equal to a thickness of the first side wall, and a recess width of the second recess part is equal to a thickness of the second side wall.

According to one embodiment of the present invention, the supporting surface of the lamp holder has a plurality of holes, and the first surface of the adapter plate has a plurality of electrical portions inserted into the plurality of the holes respectively.

According to one embodiment of the present invention, the power driving module has an AC input terminal and two DC output terminals. The AC input terminal is connected to the electrical connecting base. The DC output terminals are inserted into the plurality of the holes and are connected to the plurality of the electrical portions.

According to one embodiment of the present invention, the first end of lamp holder has an outer-thread structure, and the electrical connecting base has a joint face which is depressed with an inner-thread structure to fasten with the outer-thread structure.

According to one embodiment of the present invention, the LED bulb further includes a lamp cover used to cover the lamp plate.

In summary, through setting the connector on the adapter plate and setting a relative connector on the lamp plate for connecting the connector of the lamp plate, the LED bulb of the present invention is capable of replacing the lamp plate by pulling out the lamp plate from the adapter plate while light emitting diodes of the lamp plate has broken down.

BRIEF DESCRIPTION OF THE DRAWINGS

The invention can be more fully understood by reading the following detailed description of the embodiment, with reference made to the accompanying drawings as follows.

DETAILED DESCRIPTION

In following embodiments, a light emitting diode (LED) bulb with a replaceable power driving module and a LED light source is provided. That is, in the following embodiments, the LED bulb is capable of replacing the damaged component. More detail explanation will be described below.

Figure 1:
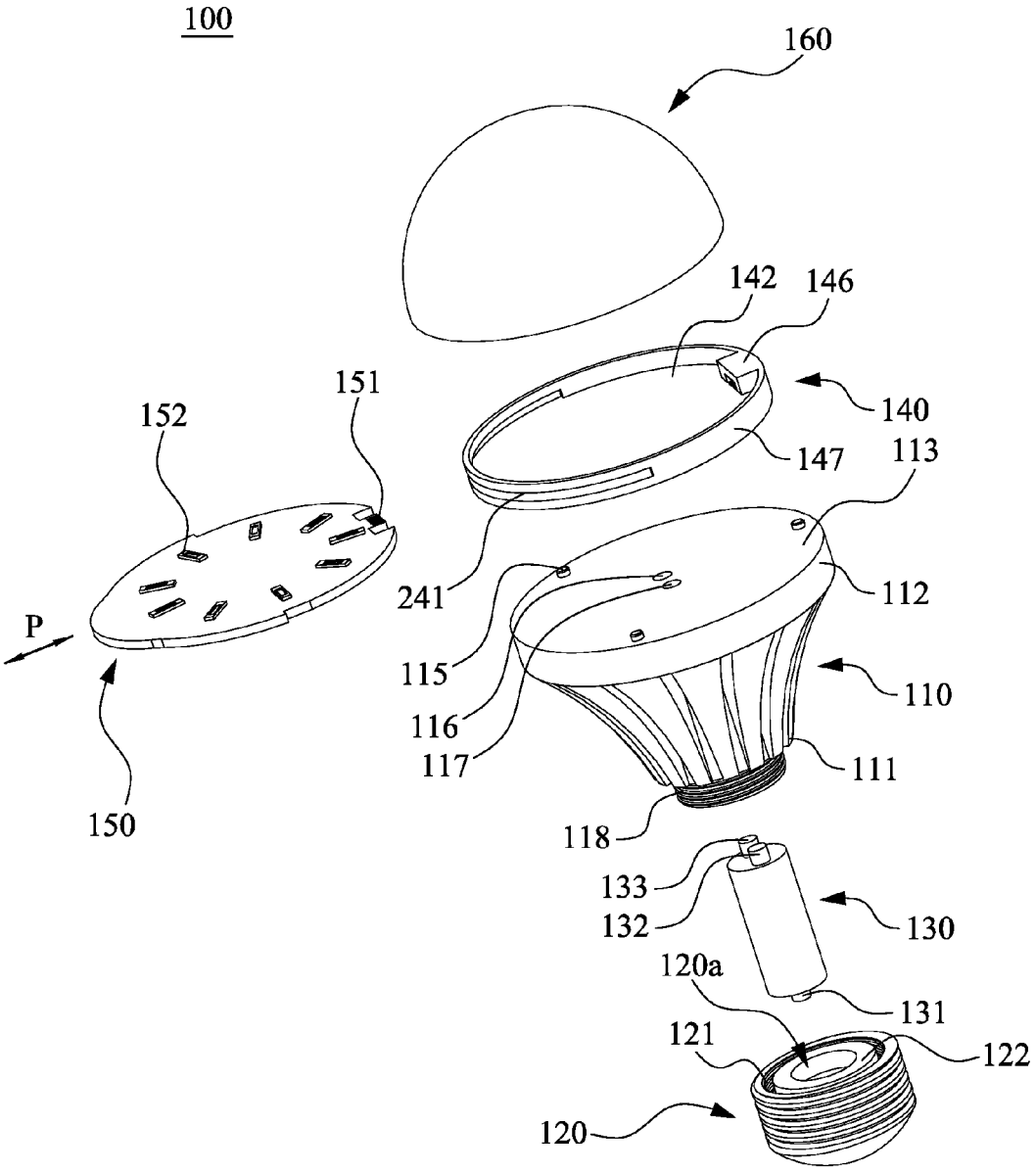
FIG. 1 illustrates an exploding view of an LED bulb from a viewpoint of a lamp cover according to one embodiment of the invention.
Figure 2:
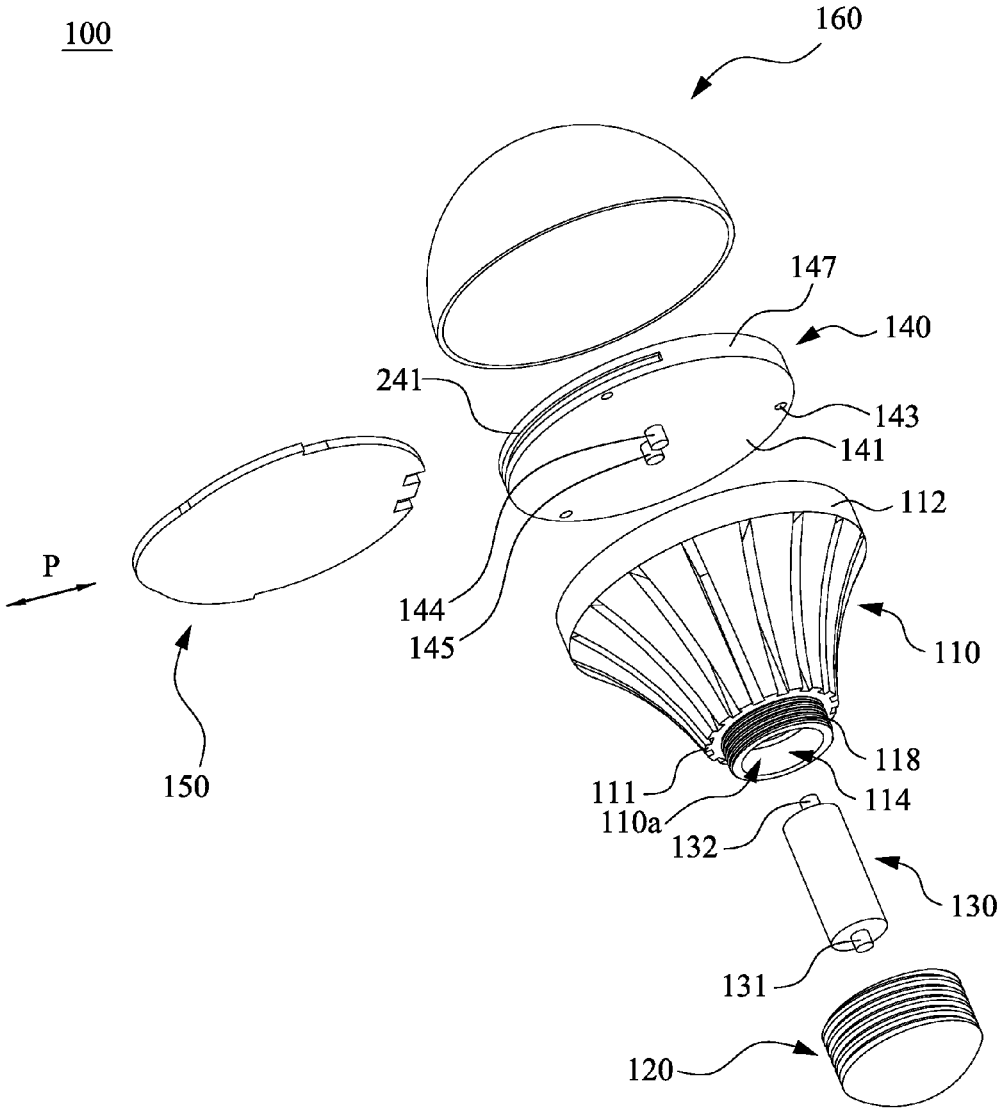
FIG. 2 illustrates an exploding view of an LED bulb from a viewpoint of an electrical connecting base according to one embodiment of the invention.

Please refer to FIG. 1 and FIG. 2, which illustrate two different exploding views of an LED bulb respectively from two different viewpoints according to one embodiment of the invention. As illustrated in FIGS. 1 and 2, the LED bulb 100 includes a lamp holder 110, an electrical connecting base 120, a power driving module 130, an adapter plate 140, a lamp plate 150, and a lamp cover 160. The lamp plate 150 is equipped with at least one LED 152. The lamp cover 160 is used to cover the lamp plate 150.

An accommodation space 114 is formed by the electrical connecting base 120 and the lamp holder 110. The accommodation space 114 is used to accommodate the power driving module 130 or some other electrical components. In more detail, the lamp holder 110 has a first end 111 and a second end 112 opposite to each other. An end of the first end 111 is connected to the electrical connecting base 120. An end of the second end 112 is configured to be a supporting surface 113. The supporting surface 113 is used to support or to carry the lamp holder 150 and the adapter plate 140. The end of the first end 111 has a recess 110*a* and the end of the electrical connecting base 120 has a recess 120*a*. The accommodation space 114 is formed by the combination of the recess 110*a* and the recess 120*a*. In present embodiment, a shape of the accommodation space 114 may be cylindrical, but is not limited thereto. In other embodiments of the present invention, the accommodation space 114 can be designed as rectangular, cube or any other shape to meet the practical needs. For example, if the power driving module 130 is a cylindrical body, then the shape of the accommodation space 114 is preferably cylindrical.

The adapter plate 140 has a first surface 141 and the second surface 142 opposite to each other. The first surface 141 is connected to the supporting surface 113. In more detail, the first surface 141 includes at least one position-limiting hole 143. The supporting surface 113 may have at least one positioning block 115. When the first surface 141 and the supporting surface 113 is connected together, the positioning block 115 may align with the position-limiting hole 143 and limited inside the position-limiting hole 143.

Furthermore, the first surface 141 may include a plurality of electrical portions 144, 145. Those electrical portions 144, 145 protrude from the first surface 141. The supporting surface 113 of the lamp holder 110 has a plurality of holes 116, 117. A location of those holes 116, 117 may be opposite to a location of the electrical portions 144,145. In present embodiment, when the positioning block 115 is positioned into the position-limiting hole 143, the electrical portions 144, 145 are inserted into the holes 115, 117 respectively. The holes 116, 117 may penetrate through the supporting surface 113 and channel to the accommodation space 114 such that when the electrical portions 144,145 are inserted into the holes 116, 117 respectively, the electrical portions 144, 145 can electrical connect to the power driving module 130.

It should be noted that, in other embodiments, there is no need for designing an additional positioning block 115 or the position-limiting hole 143 because through the configuration of the holes 116, 117 and the electrical portions 144, 145, the first surface 141 and the supporting surface 113 can also be stably connected together.

The power driving module 130 is used to convert an external AC power into a DC power for driving the LED 152 to emit the light. As illustrated in FIG. 1, the power driving module 130 has an input terminal 131 and two DC output terminals 132, 133. The AC input terminal 131 is electrical connected to the electrical connecting base 120 and the two DC output terminals 132, 133 are inserted into the holes 132, 133 to connect with the electrical portions 144, 145.

The second surface 142 is used to support or carry the lamp holder 150, and the second surface 142 includes a first connector 146 used to connect with the lamp plate 150. In present embodiment, the first connector 146 can be a female connector and the lamp holder 150 includes a second connector 151 which can be a male connector relative to the first connector 146. In other embodiments, the first connector 146 can be a male connector, and the second connector 151 can be a female connector.

In present embodiment, the first connector 146 has a plugging direction P parallel to the second surface 142. The second connector 151 of the lamp holder 150 can be detachably plugged to the first connector 146 of the second surface along the plugging direction P, so as to make the lamp holder 150 place on the adapter plate 140.

Figure 3:
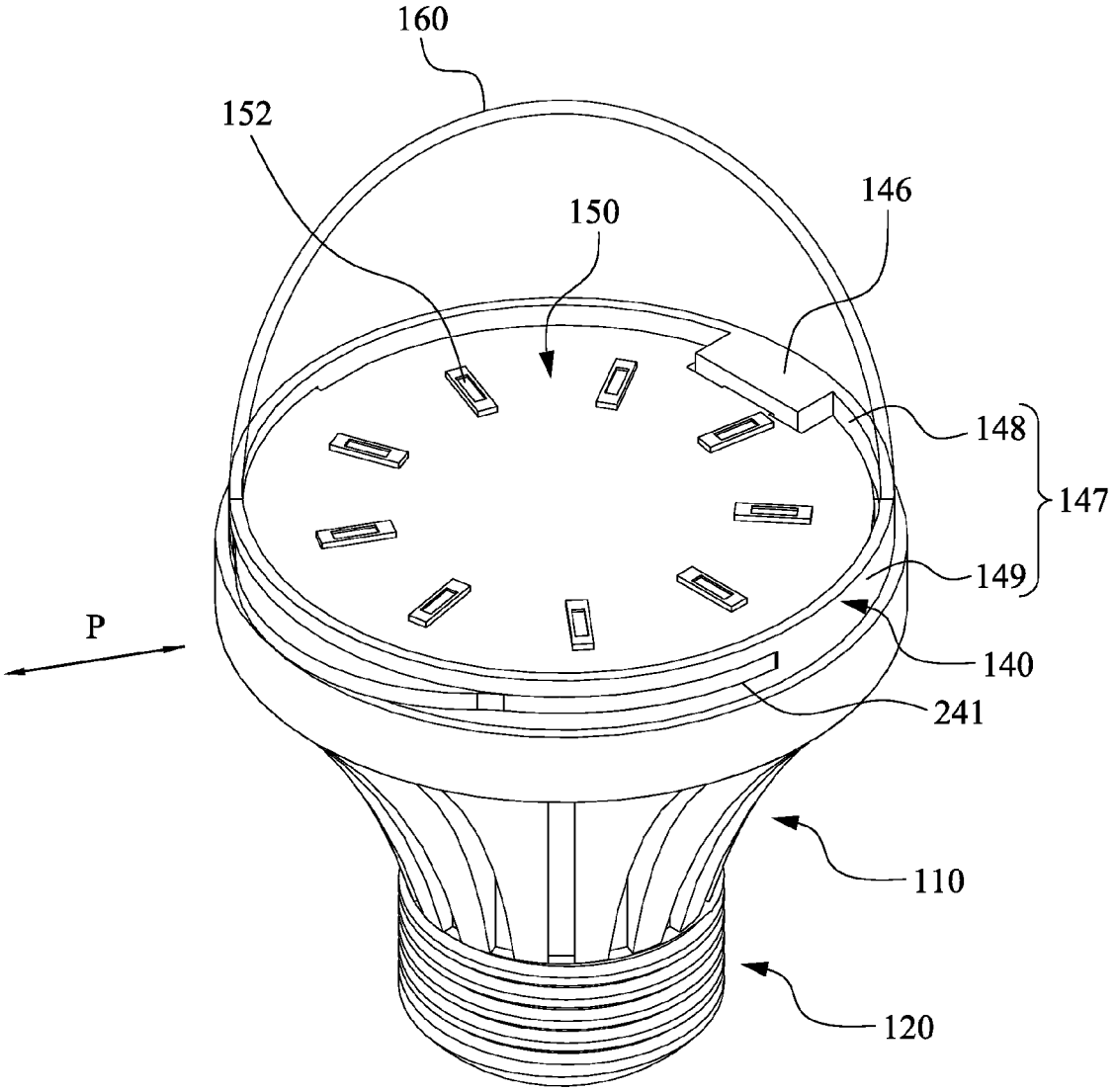
FIG. 3 illustrates an assembly view of the LED bulb according to one embodiment of the invention.

Please refer to FIG. 1 to FIG. 3, in which FIG. 3 illustrates an assembly view of the LED bulb according to one embodiment of the invention. As illustrated, the adapter plate 140 has a side wall 147. The side wall is extended from a peripheral edge of the second surface 142 and protrudes from the second surface 142 along a direction toward to the lamp cover 160, so as to encircle the second surface 142. Simply speaking, the adapter plate 140 may be a circular substrate and the side wall 147 may be an enclosing wall extended from the second surface 142.

It is worthy mentioned that, in present embodiment, the lamp cover 160 may only cover on the lamp plate 150, but not cover a side part of the adapter plate 140 so that the lamp plate 150 may pass through the side part of the adapter plate 150 and may be inserted into the first connector 146. In more detail, the side wall 147 includes an inner face 148, an outer face 149 opposite to the inner face 148, and an opening 241 which interconnects between the inner face 148 and the outer face 149. As a result, because the lamp cover 160 dose not cover the side part, the lamp plate 150 can be inserted into the first connector 146 along the plugging direction P through the opening 241. Consequently, when the LED 152 has broken down because of some reasons, the users can replace the lamp plate 150 directly.

Figure 4:
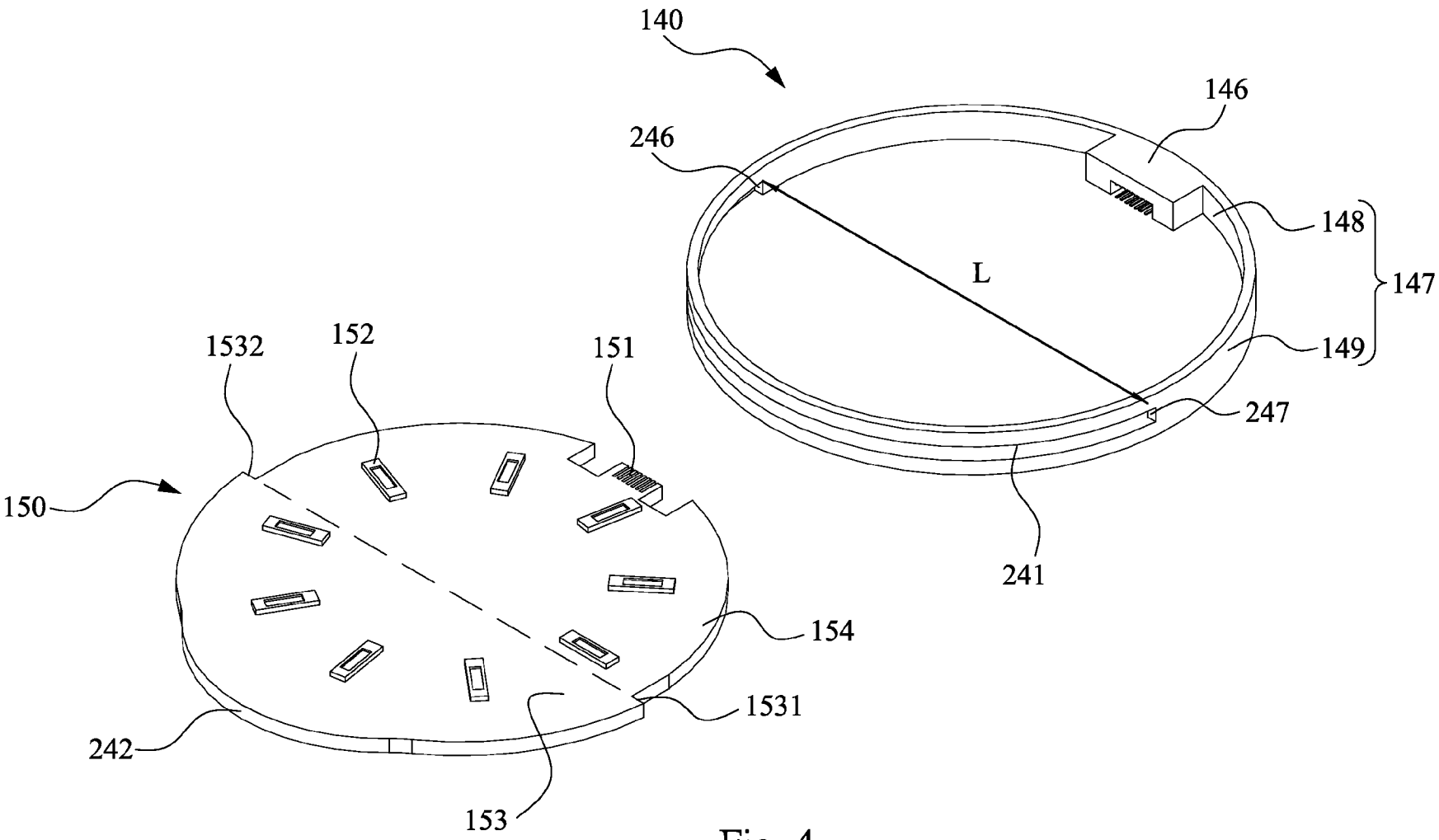
FIG. 4 illustrates a separate view of the lamp plate and the adapter plate according to one embodiment of the invention.

For a more complete understanding of the invention, a method for replacing the lamp plate 150 is described herein. Please refer to FIG. 4 and FIG. 5, which illustrate a separate view and an assemble view of the lamp plate 150 and the adapter plate 140 according to one embodiment of the invention respectively. As illustrated, the first connector 146 of the adapter plate 140 is adjacently connected to the inner face 148 of the side wall 147. The opening 241 of the adapter plate 140 is located on a position opposite to the first connector 146 and the size of the opening 241 is approximately half-area of the side wall 147.

In more detail, the adapter plate 140 of the present embodiment may be a circular substrate and the opening 241 of the side wall 147 may be an arced opening. Two terminals 246, 247 of the arced opening 241 may be located at two ends of a diameter L of the circular adapter plate 140. The lamp plate 150 may be composed of a first half-face 153 and the second half-face 154, in which an area of the first half-face 153 is greater than an area of the second half-face 154 and the first half-face 153 is physically connected with the second half-face 154 such that two end surfaces 1531, 1532 of the first half-face 153 is exposed from the second half-face 154.

In present embodiment, the first half-face 153 and the second half-face 154 may be a semi-circle, but are not limited thereto. A diameter of the first half-face 153 is greater than a width of the opening 241 and a diameter of the second half-face 154 is smaller or equal to the width of the opening 241. The second connector 151 is disposed on an edge of the second half-face 154. As a result, when the lamp plate 150 passes through the opening 241 and is connected to the first connector 146, because the width of the opening 241 is greater than or equal to a distance between any two points on the second half surface 154, the second half surface 154 is encircled inside the side wall 147. Differently, because the diameter of the first half-face 153 is greater than the opening 241, the two end surfaces 1531, 1532 of the first half-face 153 can be configured as two stopping portion respectively. After the second half-surface 154 of the lamp plate 150 passes through the opening 241 of the side wall 147, and the second connector 151 is inserted into the first connector 146, the two exposed end surfaces 1531, 1532 (configured as two stopping portion) are abutted against the two terminals 246, 247 of the opening 241 respectively.

Figure 5:
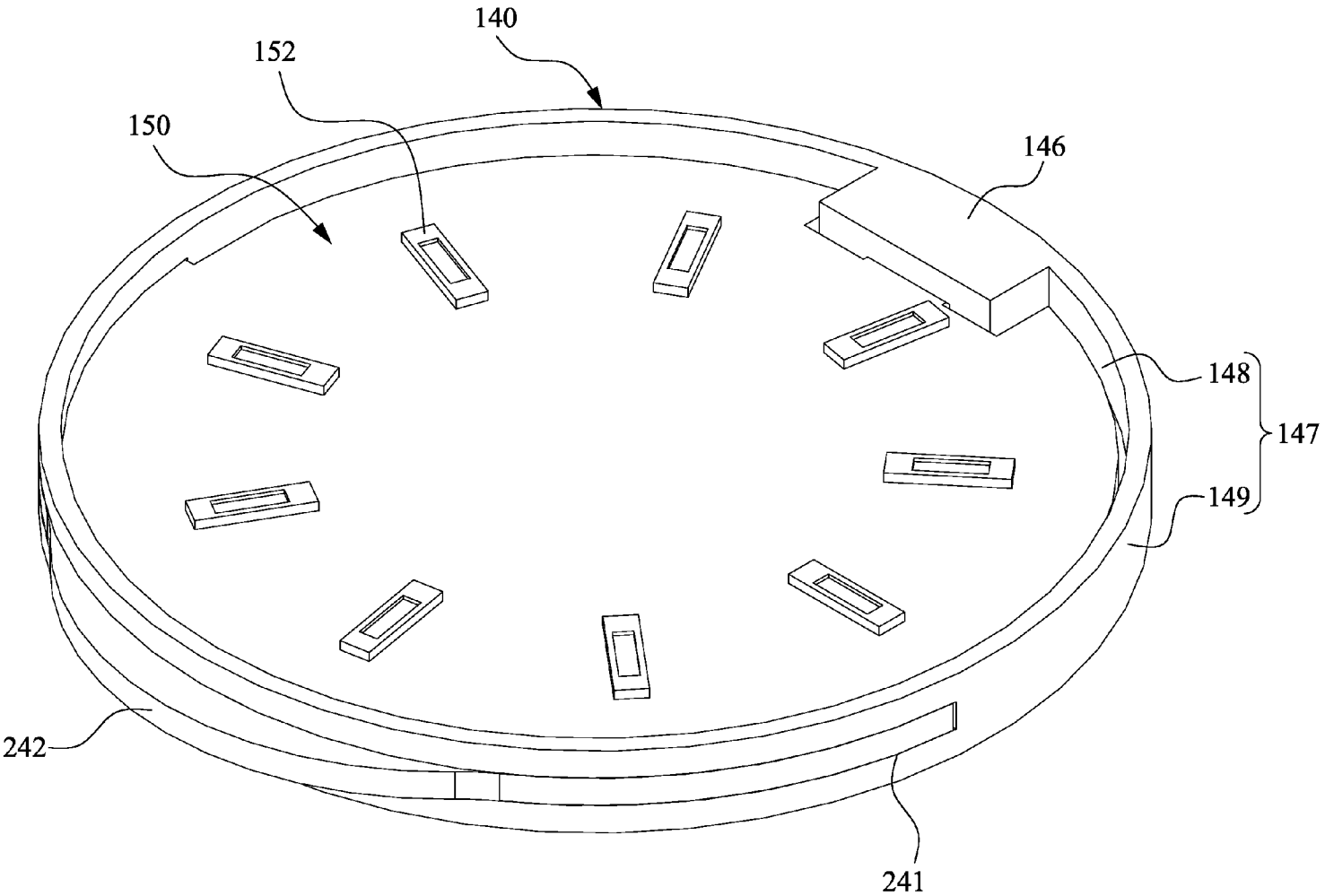
FIG. 5 illustrates an assemble view of the lamp plate and the adapter plate of FIG. 4.

Furthermore, an edge of the first half-face 153 may have a protrusion 242 located opposite to the second connector 151 of the second half-face 154. The protrusion 242 is arranged for auxiliary pushing into or pulling out the lamp plate 150 from the opening 241. As illustrated in FIG. 5, when the lamp plate 150 is combined with the adapter plate 140, the protrusion 242 may protrude out of the opening 241. Therefore, if a user need to separate the lamp plate 150 and the adapter plate 140, the protrusion 242 can be pulled so that the lamp plate 150 can be took out of the opening 241. On the other way, if a user needs to combine the lamp plate 150 with the adapter plate 140, the protrusion 242 can be used to push the lamp plate 150 through the opening 241, so as to insert the second connector 151 into the first connector 146.

Figure 6:
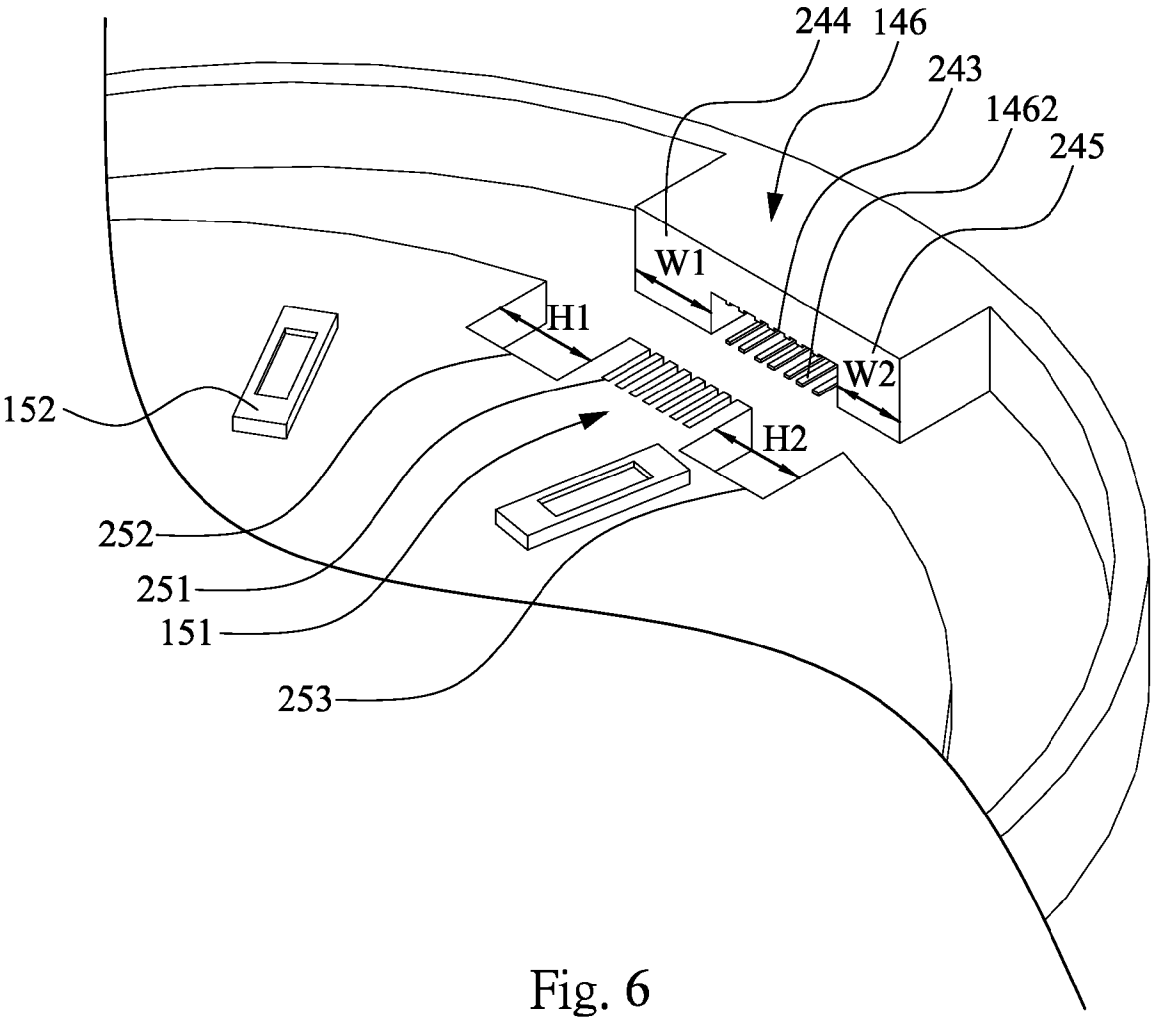
FIG. 6 illustrates an enlarged view of the first connector and the second connector of FIG. 4.

Next, FIG. 6 is referred for illustrating an enlarged view of the first connector 146 and the second connector 151 according to one embodiment of the invention. In FIG. 6, the first connector 146 is a female connector having a slot 243. The slot 243 includes a plurality of electrical contacts 1462. The second connector 151 is a male connector having a golden finger interface 251 used to insert into the slot 243 and to connect with the plurality of the electrical contacts 1462.

As illustrated, the slot 243 of the first connector 146 has a first side wall 244 and a second side wall 245 opposite to each other. An edge of the lamp plate 150 has a first recess part 252 and a second recess part 253 located on two sides of the golden finger interface 251 respectively, in which a recess width H1 of the first recess part 252 is equal to a thickness W1 of the first side wall 244 and a recess width H2 of the second recess part 253 is equal to a thickness W2 of the second side wall 245. Accordingly, while the first connector 146 is connected to the second connector 151, the first side wall 244 can be accommodated just inside the first recess part 252 and the second side wall 245 can be accommodated just inside the second recess part 253, so that the first connector 146 and the second connector 151 can be combined together stably.

It is worthy mentioned that, in some embodiment, except replacing the lamp plate 150, other components in LED bulb 100 can also be replaced as well, such as the power driving module 130. Please refer to FIG. 1 and FIG. 2. A first end 111 of the lamp holder 110 may have an outer-thread structure 118. More specifically, a side wall of the first end 111 of the lamp holder 110 may be formed by the outer-thread structure 118. Similarly, the electrical connecting base 120 has a joint face 122 suitable jointed with the lamp holder 110. The joint face 122 of the electrical connecting base 110 may be depressed with an inner-thread structure 121, so as to fasten with the outer-thread structure 118.

Thus, according to the embodiments disclosed above, not only the lamp plate 150 can be replaced while the LED 152 of the LED bulb 100 of the present embodiment has broke down, but also the power driving module 130 can be replaced through loosening the electrical connecting base 120 and the lamp holder 110 while the power driving module 130 has broke down.

In summary, the component which is apt to break down in the LED bulb of the present invention can be replaced and there is no necessity to purchase a new light bulb. In addition, the way of replacing the damaged internal component is easy and a frequency of replacing a whole bulb can be decrease, so as to reduce the cost of purchasing the LED bulb.

Although the present invention has been described in considerable detail with reference to certain embodiments thereof, other embodiments are possible. Therefore, the spirit and scope of the appended claims should not be limited to the description of the embodiments contained herein.

What is claimed is:

1. A light emitting diode (LED) bulb, comprising:

an electrical connecting base, a lamp holder having a first end and a second end opposite to each other, in which the first end is connected to the electrical connecting base, the second end is configured as a supporting surface, and an accommodation space is formed by the electrical connecting base and the lamp holder;

a power driving module disposed inside the accommodation space;

an adapter plate having a first surface and a second surface opposite to each other, in which the first surface is connected to the supporting surface and the second surface includes a first connector which has a plugging direction parallel to the second surface, wherein the adapter plate comprises a side wall, and the side wall is extended from an peripheral edge of the second surface and protrudes from the second surface to encircle the second surface; and a lamp plate equipped with a LED and a second connector detachably plugged to the first connector along the plugging direction so that the lamp plate is disposed on the adapter plate, wherein the lamp plate is composed of a first half-face and a second half-face, and the second connector is disposed on an edge of the second half-face, in which the first half-face is connected with the second half-face, and an area of the first half-face is greater than an area of the second half-face such that two end surfaces of the first half-face are exposed.

2. The LED bulb of claim 1, wherein the first connector is adjacently connected to an inner face of the side wall.

3. The LED bulb of claim 1, wherein a portion of the side wall has an opening, a position of the opening is opposite to a position of the first connector, and a width of the opening is equal to or greater than a distance between any two points on the second half surface.

4. The LED bulb of claim 3, wherein the two exposed end surfaces of the first half-face are respectively configured as two stopping portions; after the second half-face of the lamp plate passes through the opening of the side wall, and the second connector is inserted into the first connector, the two exposed end surfaces are abutted against two terminals of the opening.

5. The LED bulb of claim 3, wherein an edge of the first half-face has a protrusion configured to auxiliarly push the lamp plate into or pull out from the opening.

6. The LED bulb of claim 1, wherein the first connector has a slot which has a plurality of electrical contacts, and the second connector has a golden finger interface inserted into the slot for electrical connecting the plurality of the electrical contacts.

7. The LED bulb of claim 6, wherein the slot has a first side wall and a second side wall opposite to the first side wall, and an edge of the lamp plate has a first recess part and a second recess part located on two sides of the golden finger interface respectively, in which a recess width of the first recess part is equal to a thickness of the first side wall and a recess width of the second recess part is equal to a thickness of the second side wall.

8. The LED bulb of claim 1, wherein the supporting surface of the lamp holder has a plurality of holes, and the first surface of the adapter plate has a plurality of electrical portions inserted into the plurality of the holes respectively.

9. The LED bulb of claim 8, wherein the power driving module has an AC input terminal and two DC output terminals, the AC input terminal is connected to the electrical connecting base, and the DC output terminals are inserted into the plurality of the holes and are connected to the plurality of the electrical portions.

10. The LED bulb of claim 9, wherein the first end of lamp holder has an outer-thread structure, and the electrical connecting base has a joint face which is depressed with an inner-thread structure to fasten with the outer-thread structure.

11. The LED bulb of claim 1, further comprising a lamp cover configured to cover the lamp plate.

* * * * *